US008834208B2

(12) United States Patent
Strittmatter et al.

(10) Patent No.: US 8,834,208 B2
(45) Date of Patent: Sep. 16, 2014

(54) LOW PROFILE ELECTRICAL CONNECTOR

(75) Inventors: Patrick Clement Strittmatter, Frisco, TX (US); Devin Bertrum Pauley, San Jose, CA (US)

(73) Assignee: BlackBerry Limited, Waterloo, Ontario (CA)

( * ) Notice: Subject to any disclaimer, the term of this patent is extended or adjusted under 35 U.S.C. 154(b) by 253 days.

(21) Appl. No.: 13/251,730

(22) Filed: Oct. 3, 2011

(65) Prior Publication Data

US 2013/0084736 A1 Apr. 4, 2013

(51) Int. Cl.

| | |
|---|---|
| ***H01R 24/04*** | (2006.01) |
| ***H01R 13/50*** | (2006.01) |
| ***H01R 43/20*** | (2006.01) |
| ***H01R 13/33*** | (2006.01) |
| ***H01R 24/58*** | (2011.01) |
| *H01R 24/76* | (2011.01) |

(52) U.S. Cl.

CPC ..... *H01R 43/20* (2013.01); *H01R 13/50* (2013.01); *H01R 13/33* (2013.01); *H01R 24/58* (2013.01); *H01R 24/76* (2013.01)

USPC ..... 439/668

(58) Field of Classification Search

CPC .. H01R 24/58; H01R 2105/00; H01R 13/514; H01R 24/28; H01R 43/24; H01R 13/111; H01R 12/58; H01R 2201/16; H01R 13/187; H01R 43/00; H01R 43/20; H01R 13/66

USPC ..... 439/668, 669, 660, 606, 544

See application file for complete search history.

(56) References Cited

U.S. PATENT DOCUMENTS

| | | | | |
|---|---|---|---|---|
| 4,296,390 | A * | 10/1981 | Vanderheyden et al. | 333/182 |
| 5,277,628 | A * | 1/1994 | Lin et al. | 439/668 |
| 6,227,872 | B1 * | 5/2001 | Stephenson et al. | 439/76.1 |
| 6,312,274 | B1 | 11/2001 | Lin | |
| 6,690,801 | B2 | 2/2004 | Yeh | |
| 6,908,343 | B1 | 6/2005 | Hu | |
| 7,086,908 | B2 | 8/2006 | Fukuzaki et al. | |
| 7,097,505 | B1 | 8/2006 | Shanahan et al. | |
| 7,238,059 | B1 | 7/2007 | Wu | |
| 7,371,125 | B2 | 5/2008 | McHugh et al. | |
| 7,387,543 | B1 | 6/2008 | Wu et al. | |
| 7,470,153 | B2 | 12/2008 | Han et al. | |

(Continued)

FOREIGN PATENT DOCUMENTS

DE 102005039845 3/2006

OTHER PUBLICATIONS

EESR dated Mar. 5, 2012 for EP application No. 11183170.

(Continued)

*Primary Examiner* — Xuong Chung Trans

(74) *Attorney, Agent, or Firm* — Jon A. Gibbons; Fleit Gibbons Gutman Bongini & Bianco PL

(57) ABSTRACT

An electrical device has a socket formed as a continuous integral portion of an outer case housing. Conductors connect an interior of the socket to circuits within the device, and may be integrally molded with the outer case housing. Separate case housings may be assembled together to form the socket. A resulting socket has a lower profile and a reduced impact to a height requirement within the case, and has a relatively greater strength attributable to the inherent robustness of the case.

17 Claims, 10 Drawing Sheets

(56) References Cited

U.S. PATENT DOCUMENTS

| | | | | |
|---|---|---|---|---|
| 7,534,146 | B2 | 5/2009 | Chien et al. | |
| 7,654,872 | B2 | 2/2010 | Lin et al. | |
| 7,785,119 | B1 | 8/2010 | Chiang | |
| 7,854,633 | B2 * | 12/2010 | Lynch et al. | 439/669 |
| 7,871,299 | B2 * | 1/2011 | Kawasaki et al. | 439/669 |
| 7,942,705 | B2 * | 5/2011 | Murphy et al. | 439/668 |
| 8,047,878 | B2 * | 11/2011 | Szini et al. | 439/668 |
| 8,100,726 | B2 * | 1/2012 | Harlan et al. | 439/669 |
| 8,118,617 | B2 * | 2/2012 | Jol | 439/668 |
| 8,123,569 | B2 * | 2/2012 | Little et al. | 439/669 |
| 8,267,727 | B2 * | 9/2012 | Lynch et al. | 439/669 |
| 8,353,729 | B2 * | 1/2013 | Dabov et al. | 439/668 |
| 2005/0181664 | A1 | 8/2005 | Fukuzaki et al. | |
| 2008/0299835 | A1 | 12/2008 | Lin et al. | |
| 2008/0318457 | A1 | 12/2008 | Li et al. | |
| 2009/0275243 | A1 | 11/2009 | Myers et al. | |
| 2010/0190382 | A1 | 7/2010 | Szini et al. | |

OTHER PUBLICATIONS

Canadian Office Action dated Sep. 6, 2013 for Canadian Patent Application No. 2,791,678.

* cited by examiner

LOW PROFILE ELECTRICAL CONNECTOR

FIELD OF THE DISCLOSURE

The present disclosure generally relates to electrical connectors with mating connecting portions, and more particularly to low profile connectors for small electronic devices.

BACKGROUND

Audio and other devices requiring a connection to an external device, such as headphones, employ connectors which receive a plug. When the plug is inserted into the connector, an electrical connection is formed between the inserted plug and a circuit within the device.

More particularly, such connectors include a connector housing which physically supports an inserted portion of the plug. The connector housing in turn, generally is connected to a circuit board disposed within the device, and possibly to other structures within the device or the device housing. Forces transmitted to a plug inserted into the connector are transferred first to the connector housing, and then to the circuit board to which the connector housing is attached, and possibly to other structures within the device.

The size, especially the thickness, of handheld electronic devices continues to shrink. However, accommodating connectors and plugs in handheld devices is a challenge within a thinner profile. Often times these connectors face a side of the device that has a very thin profile making integration of a connector, for example a stereo headset connector, increasingly difficult.

BRIEF DESCRIPTION OF THE DRAWINGS

The accompanying figures, where like reference numerals refer to identical or functionally similar elements throughout the separate views, and which together with the detailed description below are incorporated in and form part of the specification, serve to further illustrate various examples and to explain various principles and advantages all in accordance with the present disclosure, in which.

DETAILED DESCRIPTION

As required, detailed examples are disclosed herein; however, it is to be understood that the disclosed examples are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the present subject matter in virtually any appropriately detailed structure and function. Further, the terms and phrases used herein are not intended to be limiting, but rather, to provide an understandable description of the concepts.

The terms "a" or "an", as used herein, are defined as one or more than one. The term "plurality", as used herein, is defined as two or more than two. The term "another", as used herein, is defined as at least a second or more. The terms "including" and "having", as used herein, are defined as comprising (i.e., open language). The term "coupled", as used herein, is defined as "connected", although not necessarily directly, and not necessarily mechanically.

Figure 1:
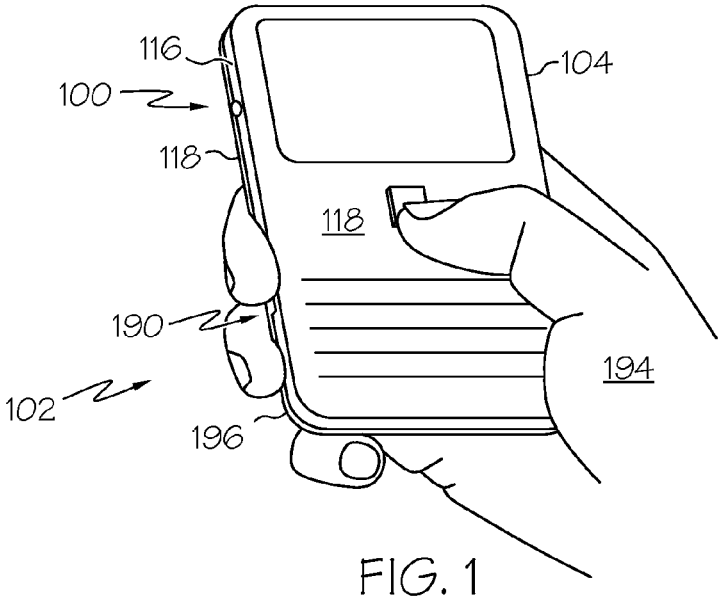
FIG. 1 is a front of a handheld electronic device with connectors located on a side.
Figure 2:
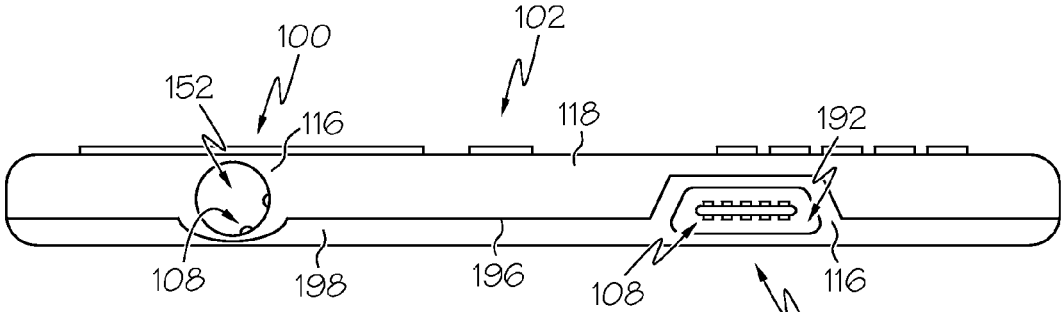
FIG. 2 is a side view of FIG. 1.
Figure 3:
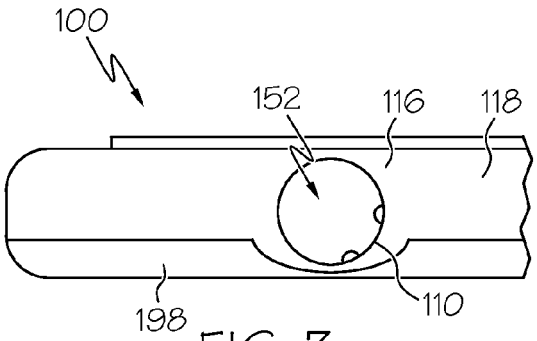
FIG. 3 is an expanded view of a connector in FIG. 2.

FIG. 1 is a front of an apparatus 102, such as a handheld electronic device, with an audio connector 100 located on a side 102. FIG. 2 is a side view of FIG. 1, and FIG. 3 is an expanded view of the connector in FIG. 2. Other electronic devices which may advantageously employ a connector 100 include, but are not limited to, cell, radio, or other wireless phone; wired phones, music players, game devices, handheld computers, tablet computers, ebook readers, portable computers; laptop computers, and peripheral devices FIGS. 1-3 illustrate a user 194 grasping apparatus 102, which as illustrated, is a thin handheld electronic device. In this example the handheld device shown is slightly thicker than a 3.5 mm audio connector. Audio connector 100 is positioned along a side surface of apparatus 102. Apparatus 102 has two connectors 100, 190 positioned along one side of apparatus 102, however any number of connectors may be positioned anywhere upon case 118. Two mating cases 118, 198 are illustrated; however, a single upper case 118 or any number of case portions may be joined to form a complete case. In the example shown, case 118 is provided with a connector 100. An upper case 118 forms connector aperture 152, and a lower case 198 forms connector aperture 192. Line 196 represents a joining mating surface of upper case 118 and lower case 198, and may form a smooth surface, or may form a relief, as dictated by a desired or practical physical appearance of apparatus 102.

With respect to connector 100, it may be seen that an overall thickness of apparatus 102 is close in size to a diameter or height of aperture 152, which is possible due to the formation of aperture 152 from case material 116. With respect to connector 190, it may be seen that aperture 192 has relatively less height than aperture 152; however, an internal structure of connector 190 may require more height than a height of aperture 192.

In other examples, as may be seen in FIG. 3, the connector aperture 152 is formed within the upper case 118, and a the lower case 198 may be provided to extend to surround an opening 110 into aperture 152, or additional strength or protection, or for design or aesthetic purposes.

In this example, a connector 100 enables a thinner associated apparatus 102, such as a handheld electronic device because the case 118 itself forms part of the connector as further described below. Connector 100 has a configuration of a headphone connector; however, many varieties of multimedia, data, power, antenna, network connector, outlet or may advantageously be formed in accordance with other examples described herein. A reduction is enabled in the overall size and footprint of a plug or connector 100, while maintaining the requisite strength and reliability when used within apparatus 102. Moreover, equivalent or improved reliability is enabled.

A further advantage is an improvement in tolerance stackup, or the potentially cumulative variation of multiple parts. As a location of connector 100 is closely coupled with housing 116 of apparatus 102, an orientation of a connector in at least two directional dimensions is reliably established. Further, a reduction of a total parts count is enabled.

Figure 4:
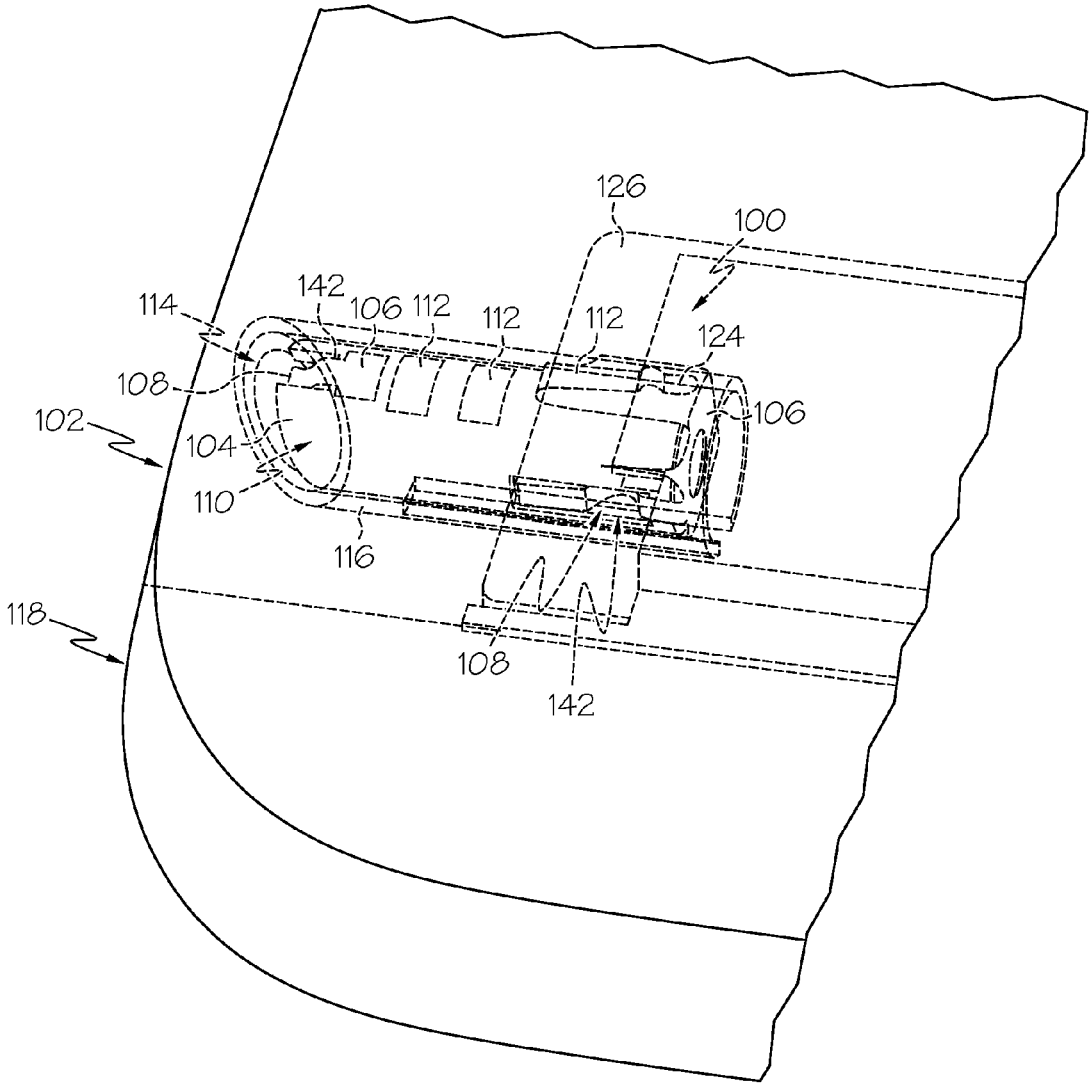
FIG. 4 is a partial bottom view of the connector in an opening formed in a housing of the handheld electronic device.

Referring now to FIG. 4, shown is a partial bottom view of the connector in an opening formed in a housing of the apparatus 102, such as the handheld electronic device discussed above.

In the example shown in FIG. 4, stereo headset connector 100, for example a 2.5 or 3.5 mm connector, includes a thin-walled sleeve 104 for receiving a mating 2.5 or 3.5 mm male connector, not shown. Sleeve 104 is thin-walled in that the wall thickness is too thin, using typical prior art materials, to adequately support the manipulations and pressures to which the connector would normally be subjected during typical use, particularly over an extended period of time.

Figure 5:
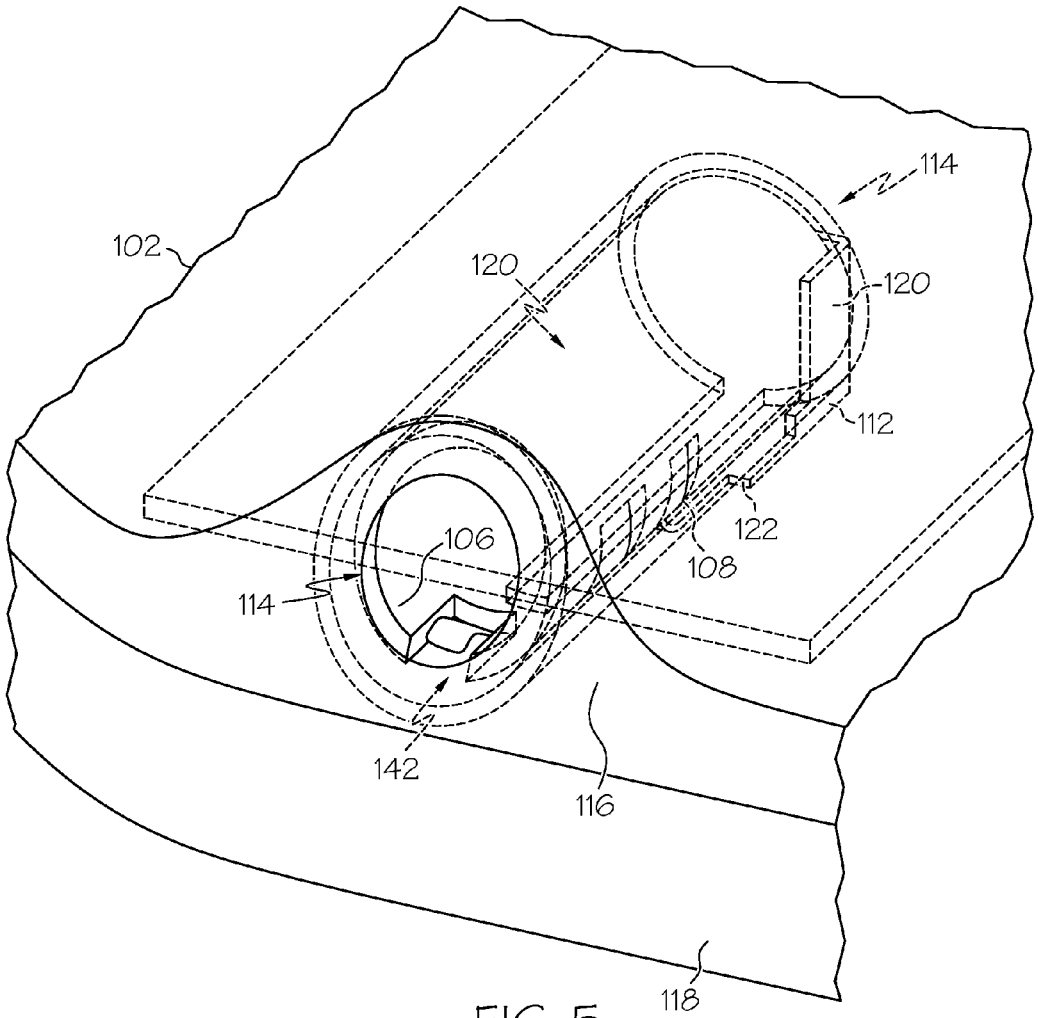
FIG. 5 is a front perspective view of a connector sleeve disposed within the opening formed in the housing of FIG. 4.
Figure 6:
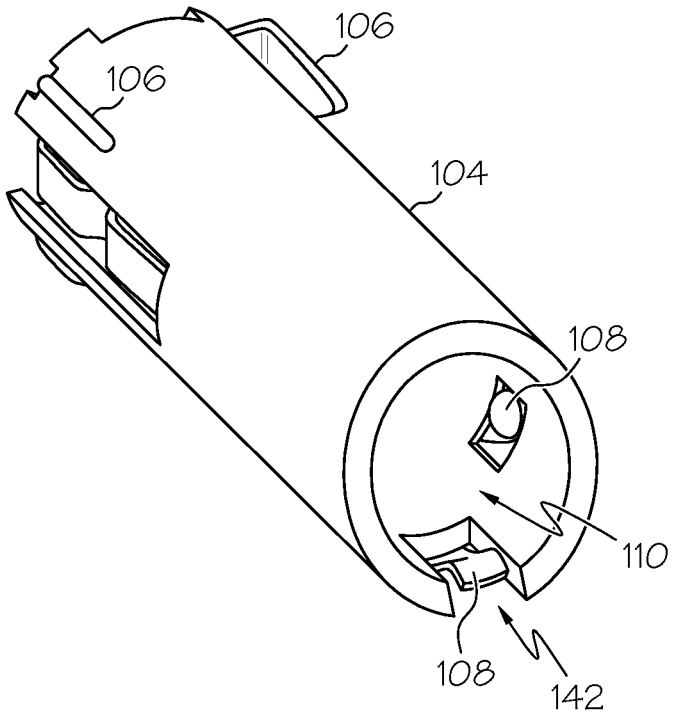
FIG. 6 depicts a perspective view of the connector sleeve of FIG. 5.

The example of sleeve 104 illustrated in FIGS. 4-6 includes non-conductive material. Example materials include polymers, for example polyamide, polyethylene, and polyvinyl chloride, but may also include, for example, epoxy, phenolic plastics, and ceramics. Sleeve 104 may be made with any insulating material generally considered suitable for the intended connection type.

In FIG. 4, conductors 106 are positioned with interior contact portions 108 at locations disposed in an interior 110 of sleeve 104, each conductor operative to form a current carrying connection with an appropriate portion of a mating plug, for example a mating male connector, inserted within sleeve 104. Conductors 106 communicate electrical current from interior contact portions 108 to exterior contact portions 112, located about the exterior of sleeve 104. One or more passages 142 are provided within sleeve 104 through which conductors 106 may pass.

Further, in one example, sleeve 104 is press-fit into an opening, socket, or aperture 114 formed, in this example, as a substantially continuous cylindrical extension of the case material 116. In this manner, case material 116 imparts additional rigidity to sleeve 104, whereby the assembled aperture 114 and sleeve 104, act together to form a connector 100 that is sufficiently strong and reliable for an intended use. The aperture 114 as a cylindrical extension to housing or case material 116 forms at least a portion of the case 118. As such, the aperture 114 formed as cylindrical extension to the case material 116 is designed to be sufficiently thick or rugged to withstand the maximum amount of impact and pressure, or are intended to be, applied to apparatus 102 during use. By inserting at least a portion of sleeve 104 within the aperture 114 formed as cylindrical extension to the case material 116, sleeve 104 leverages this additional inherent strength, while reducing a required bulk of a suitably strong connector.

If a gap exists between sleeve 104 and aperture 114, as in a slip fit, case 118 and/or sleeve 104 would be required to bend before a reinforcement of sleeve 104 by case 118 may take place. Accordingly, a press-fit provides strong support between sleeve 104 and an aperture 114 formed as cylindrical extension to the case material 116 of case 118. A press-fit, also known as an interference or friction fit, is a close conforming engagement of sleeve 104 and the aperture 114 formed in the case material 116, whereby the parts are held in relative assembled position by a friction between them. Sleeve 104 undergoes pressure during and after insertion within aperture 104, and may reduce in diameter or peripheral dimension during positioning. As such, case 118 directly imparts physical strength and support within the cylindrical extension to sleeve 104, without requiring significant bending of sleeve 104 before supporting contact with case 118 is achieved. It should be understood that a press-fit may be accomplished with non-tubular shapes, and as such, it is not required that sleeve 104 be tubular or rounded.

FIG. 5 is a front perspective view of a connector sleeve disposed within the opening or aperture 114 formed as cylindrical extension to the in the housing 116 of FIG. 4. An opening 120 is provided within aperture 114, in one example, operative to admit passage of exterior contact portions 112 through case material 118 as shown. In this manner, sleeve 104 may be assembled into case 118 or case material 116, and thereafter an electrical contact may be formed between conductors 106 and circuit conductors 122 associated with other portions of apparatus 102.

As may be seen in FIG. 4, some of the conductors 106 may have a resilient contact 124 operative to bias exterior contact portions 112 in a direction of circuit conductors 122, which may, for example, be positioned upon an electronic circuit board, for example a electrical circuit board or printed circuit board (PCB) 126. In this manner, PCB 126 may be positioned in a specified location within case 118, and the correct electrical connections are formed between connector 100 and PCB 126, the connections aligned by respective alignments of connector 100 and PCB 126, with case 118.

Conductors 106 may be fabricated, for example, using brass, phosphor bronze, gold flash, gold, aluminum, steel, or any other conductive material, of suitable thickness for desired reliability, resiliency, and or current carrying capacity.

In one example, PCB 126 is slid or otherwise positioned into a retaining location within housing 116, causing the resilient contact 124 to press upon designated contact locations 122 upon PCB 126. Other examples of resilient contact 124 are further described below in FIG. 11 and FIG. 12. Resilient contact 124 may be formed by any known means, including a resilient pad biasing a contact in a direction extending away from sleeve 104; a resilient bent or curved portion of metal, for example a bent wire, band, spring, or strip; or, a spring backed blade or pad.

FIG. 6 depicts a perspective view of the connector sleeve 104 of FIG. 5. The sleeve 104, in this example, has a blade shaped conductor 106. The conductor 106 may be resiliently mounted to sleeve 104 as described, or may be relatively rigidly fixed to sleeve 104.

Conductors 106 in further designs may further operate to add rigidity to a mounted position of sleeve 104 within housing 116, and may additionally operate to guide sleeve 104 into a position within housing 116, or to guide a path of circuit conductors 122, and to thereby aid in aligning sleeve 104 and a circuit element associated with circuit conductors 122.

Figure 7:
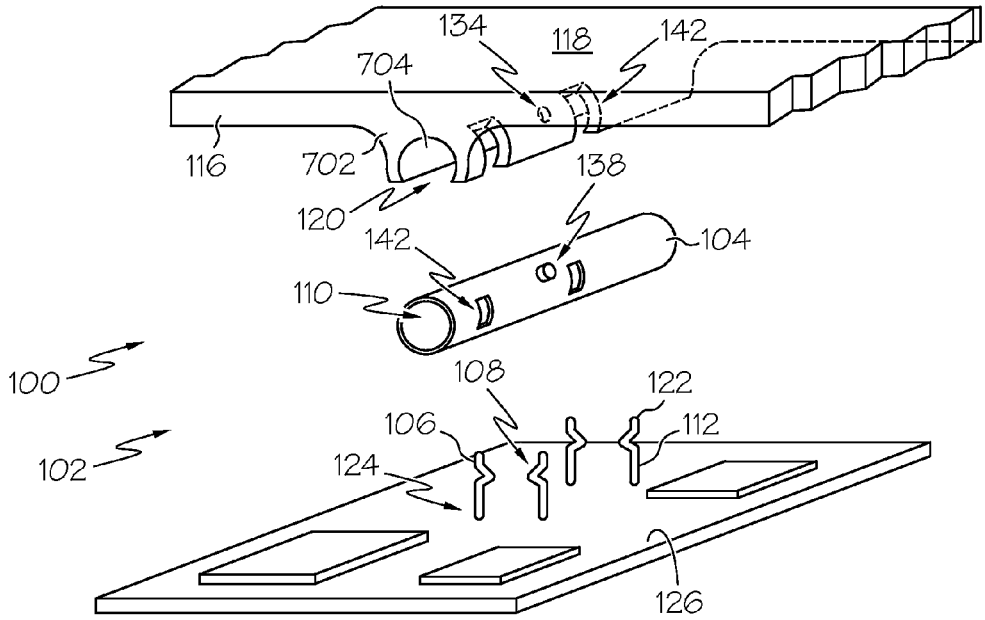
FIG. 7 is an exploded side view of a connector assembly with a partial circular opening.

Turning now to FIG. 7, shown is an exploded side view of a connector assembly with a partial circular opening. Housing 116 is fabricated to form a press-fit or snap-fit support structure 702 to sleeve 104. A snap-fit connection herein is a form of press-fit connection where the sleeve 104 is inserted into the opening 120 along support structure 702. Housing 116 may be fabricated using any suitable known means, including for example molding, injection molding, insert injection molding, rotational molding, slush molding, casting, thermoforming, forming, extrusion encapsulation, lamination, wet or dry layup, extrusion, additive or ablative fabrication, drilling, milling, stamping, or combination thereof. Case material 116 may additionally be formed using a combination of fabrication steps.

Case material 116, case portions 118 and 198, or other connector 100 member, may be fabricated, for example, with a polymer, a metal, a synthetic material, or a composite material. More particularly, examples include plastic; aluminum; steel; magnesium; metal alloy; composite; alloy of polycarbonate resins; Thermocomp DX06313 polycarbonate glass (Thermocomp is a registered trademark of Sabic Innovative Plastics IP, B.V., Netherlands); polyarylamide with filler; IXEF 1622, a polyarylamide with glass filler (IXEF is a registered trademark of Solvay Corp., Belgium); a synthetic resin, or combination thereof.

An exemplary wall thickness of case 118 is 0.4 mm, although any thickness may be used, for example 0.01 to 10 mm, although the examples are not limited to any particular thickness.

Figure 8:
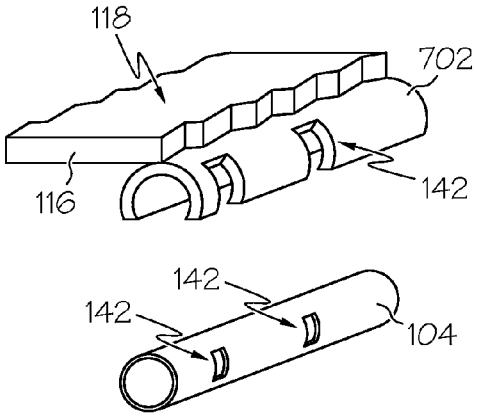
FIG. 8 is an expanded view of the connector in FIG. 7 prior to placement within a housing.
Figure 9:
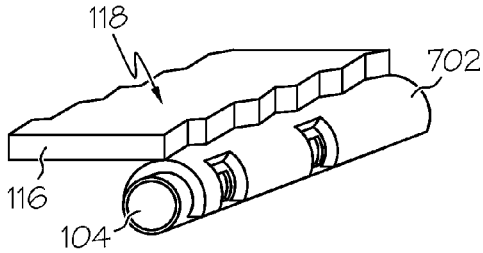
FIG. 9 is an expanded view of the connector in FIG. 7 after placement within a housing.

In FIGS. 7-9, snap fit support structure 702 is formed to extend along a substantial portion of the length of sleeve 104, although support structure 702 may extend to a length longer than sleeve 104, may be substantially shorter than sleeve 104, or may be disposed intermittently along sleeve 104. Snap fit connection is generally of a length sufficient to impart adequate holding and support of sleeve 104 to, for example, provide resistance to bending, or maintenance of alignment of separate parts, for an intended application of connector 100.

A stop indent or stop feature 134 may be provided to prevent sleeve 104 from being displaced in a direction along a longitudinal axis of sleeve 104, cooperative with a mating stop member 138. In FIG. 7, stop feature 134 is a recess or opening, and mating stop member 138 is a protrusion, although a protrusion may be formed on sleeve 104, and a mating recess formed in case material 116. Stop feature 134 and mating stop member 138 may be formed anywhere along the length of sleeve 104, or a stop member may be positioned at an end of sleeve 104, operative to interfere with movement of an end of sleeve 104 in a longitudinal direction. In an alternative example, stop feature 134 and or mating stop member 138 are not provided. In such designs, as other techniques are used to prevent a movement of sleeve 104 within snap-fit support structure 702. For example, friction between sleeve 104 and snap-fit support structure 702 may be sufficient, particularly if, in one example, mating surfaces of sleeve 104 and snap-fit structure 702 are roughened, or knurled. Alternatively, an adhesive may be used between mating surfaces of sleeve 104 and snap-fit structure 702. Other techniques include one or more straps, hooks, fasteners, screws, pins or a combination thereof.

Alternatively, or in addition to the foregoing, as may be seen in the example of FIG. 7, circuit conductors 122 may operate to prevent movement of sleeve 104, and particularly movement along a longitudinal axis of sleeve 104. In one example, contact portions 108 extend through snap-fit holder apertures 140 in snap-fit structure 702, and sleeve contact apertures 142 in sleeve 104, and thus operate in a similar manner to stop feature 134 and mating stop member 138, and may alone provide adequate longitudinal fixation, or may contribute to the fixation of the press-fit between sleeve 104 and snap-fit structure 702.

Snap-fit structure 702 is formed with a partial cylindrical structure 120 extending an entire length of an opening into a shaped chamber 704, although may be provided to extend only a portion of the length of shaped chamber 704. The aperture is sufficiently large, and the case material 116 sufficiently resilient, that sleeve 104 may be forced upwards into chamber 704, bending case material 116 apart in order to admit sleeve 104. Once sleeve 104 is seated within chamber 704, case material 116 may return to a former position, whereby sleeve 104 is advantageously secured within chamber 704 in close fitting conformity with housing or case material 116. When case material 116 returns to a former position, a snapping sound may be to be emitted, so that an assembly worker may hear an auditory confirmation of a suitable positioning of sleeve 104. In this example, the sleeve 104 may have thickness to enable a press-fit without deforming while being supported by chamber 704 to provide the requisite strength and reliability during use.

Turning now to FIG. 8, shown is an expanded view of the connector in FIG. 7 prior to placement within a housing and FIG. 9 is an expanded view of the connector in FIG. 7 after placement within a housing. The sleeve 104 is positioned within chamber 704, and an alternative manner of forming snap-fit structure 702, in which connector 702 extends laterally from case material 116. It should thus be understood that connector 702 may be oriented in any of a variety of ways, with respect to a remainder of case 118, provided sufficient material 116 joins snap-fit structure 702 to case 118 for imparting a required strength to connector 100.

Figure 10:
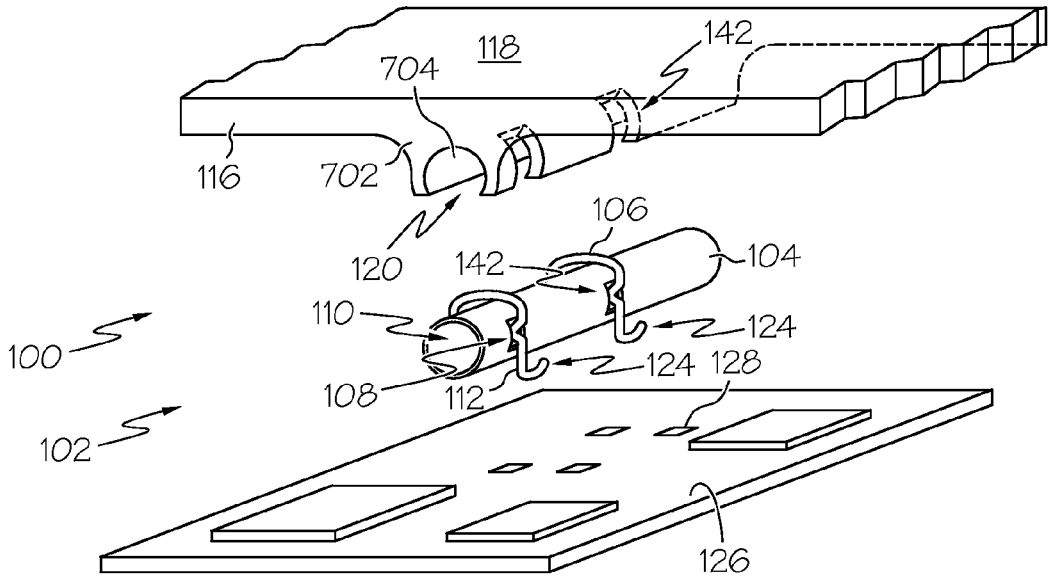
FIG. 10 is an exploded side view of another example of a connector assembly with electrical connectors coupled to a connector sleeve into a partial circular opening.
Figure 11:
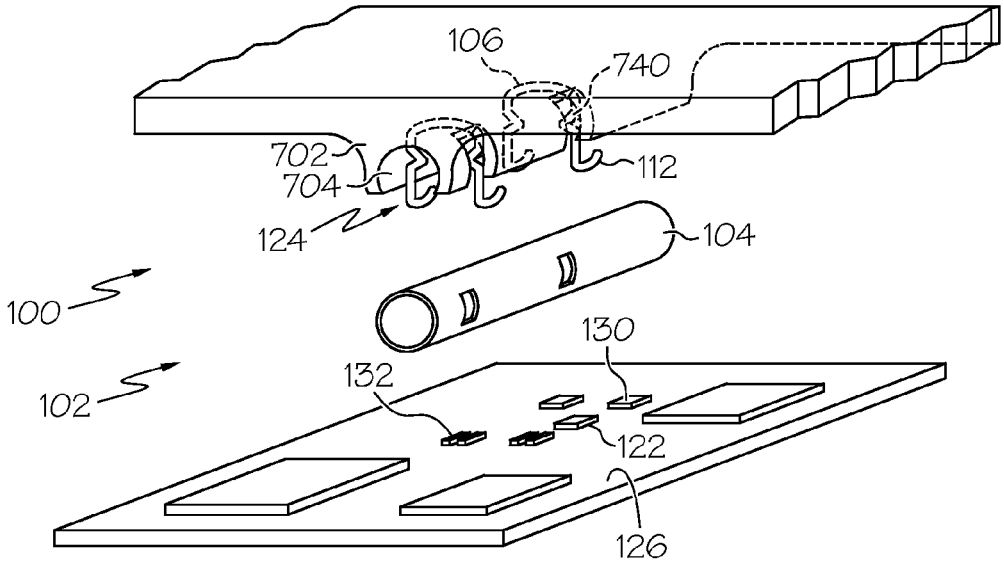
FIG. 11 is an exploded side view of another example of a connector assembly with electrical connectors coupled to the housing.

With reference to FIG. 10, shown is an exploded side view of another example of a connector assembly with electrical connectors coupled to a connector sleeve into a partial circular opening. One or more resilient contacts 124 are initially associated with sleeve 104. By positioning contact portions 108 into 142, the assembled sleeve 104 and contact 124 are subsequently inserted into snap-fit structure 702. Alternatively, shown in FIG. 11 is an exploded side view of another example of a connector assembly with electrical connectors coupled to the housing. Resilient contacts 124 are initially inserted into chamber 704, and sleeve 104 is subsequently inserted into chamber 704, as illustrated in FIG. 11. In either event, it may not be necessary to include snap-fit structure apertures 740, if resilient contacts 124 are sufficiently thin, or if there is sufficient clearance within chamber 704. Sleeve 104 may be press-fit or snap-fit within snap-fit structure 702 prior to assembly of PCB 126 into case 118 which mates with case material 116, or simultaneously therewith. In each case, connectors 106 form required electrical connections with conductors 122 after assembly as described below.

In FIG. 11, two types of PCB conductors are illustrated: resilient contact locations 130, and pinching contact locations 132; however, any combination of non-resilient conductor 122, resilient contact location 130, or pinching contact location 132 may be used. Further, any type of conductor 106 or 122, as described herein, may be positioned on snap-fit structure 702, sleeve 104, or PCB 126, as meets requirements of an intended application, or as benefits the convenience or cost of manufacturing.

Figure 12:
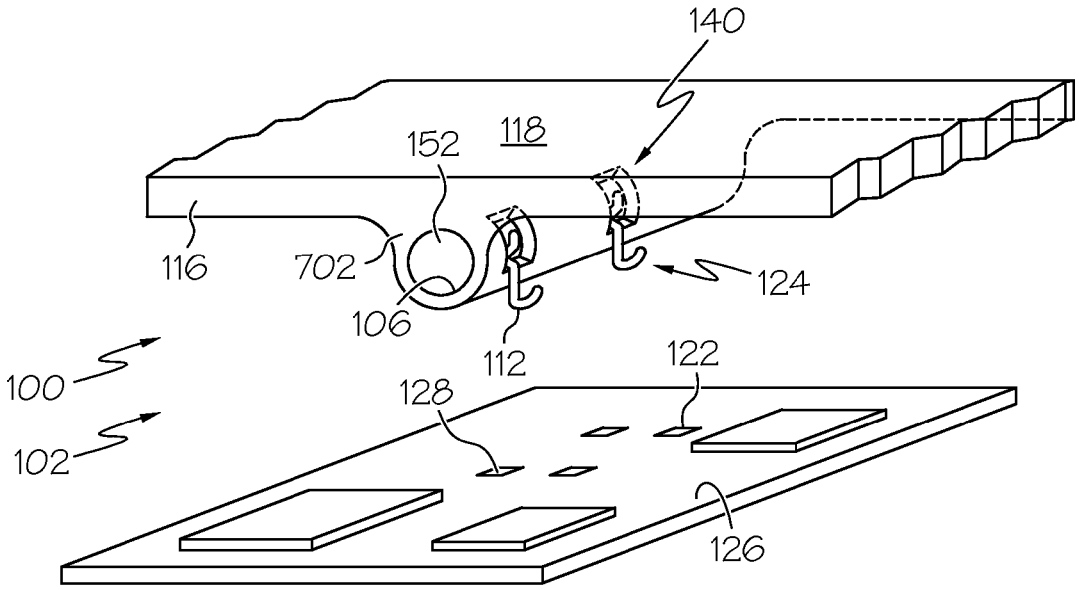
FIG. 12 is an exploded side view of another example of a connector assembly with electrical connectors coupled to a connector sleeve inside a full circular opening.

In another example, FIG. 12 is an exploded side view of a connector assembly with electrical connectors coupled to the housing. In this example, sleeve 104 is eliminated, and a suitably shaped connection aperture 152 is formed within case material 116 of case 118. In the example shown in FIGS. 12-13, connection aperture 152 is formed as a complete tube, although a circumference which is partially complete, but sufficient to retain an inserted mating connector portion, may alternatively be provided. While a tubular aperture is illustrated, it should be understood that connection aperture 152 may have any shape that is operative to mateably retain a mating connector portion.

In FIG. 12, conductors 106 and exterior contact portions 112 extend from case material 116. More particularly, housing or case 118 forms a substantial portion of an exterior surface of the apparatus, and extends to form the aperture. In one example, case material 116 continuously forms, as a monolithic or unitary piece, a substantial portion of an exterior surface of apparatus 102 and aperture 152, where aperture 152 extends from an exterior of case 118 towards an interior formed by case 118. In this manner, the strength and rigidity of case 118 is attributed to aperture 152. As such, a mechanical force imparted to an inserted connector during use of apparatus 102 is transferred to case 118, which is sufficiently strong to maintain integrity of aperture 152, and to reduce or prevent damage to apparatus 102.

Conductors 106 may be connected to case 118 by being partially embedded within case material 116, or may be attached thereto by any suitable means, including for example, adhesive, pins, screws, resilient pressure of conductors 106 within connection aperture 152, or a conforming fit, or molded within a recess within connection aperture 152, for example by insert injection molding. Snap-fit holder apertures 140 may be eliminated if conductors 106 are molded within case material 116, or if conductors 106 pass through connection aperture 152. In each example, conductors 106 are supported along at least a portion of their length by case material 116.

Figure 13:
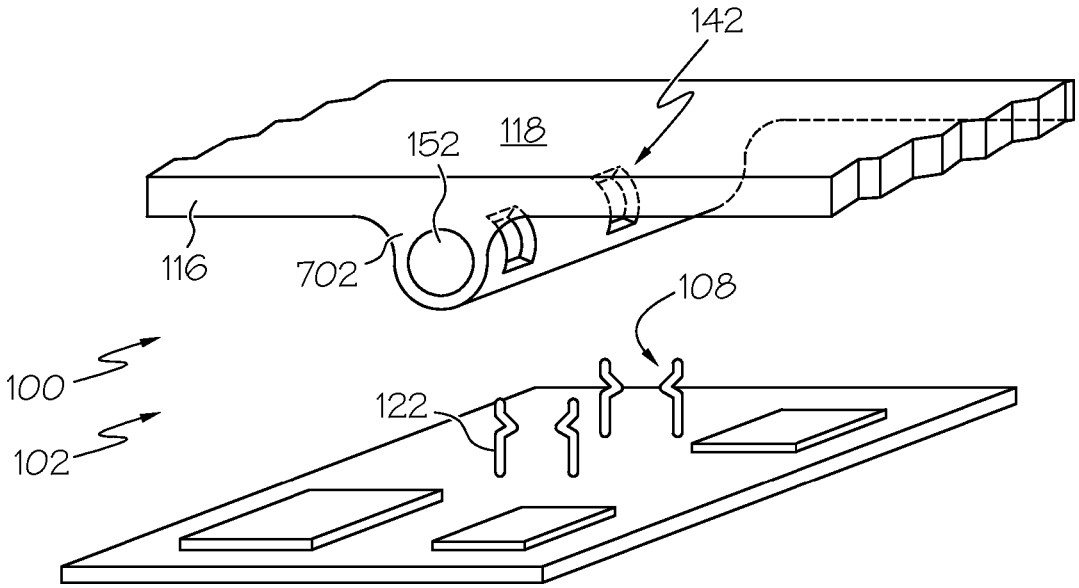
FIG. 13 is an exploded side view of another example of a connector assembly with a connector sleeve inside a full circular opening and electrical contacts coupled to a printed circuit board.

Alternatively, as may be seen in FIG. 13, shown is an exploded side view of another example of a connector assembly with a connector sleeve inside a full circular opening and electrical contacts 108 coupled to a PCB 126. The contact portions 108 enter connection aperture 152, where they may contact a mating connector portion inserted within connection aperture 152. In this example, conductors are advantageously correctly positioned as a result of assembling PCB 126 or other structure supporting conductors 106, when the supporting structure is aligned and assembled into case 118.

Figure 14:
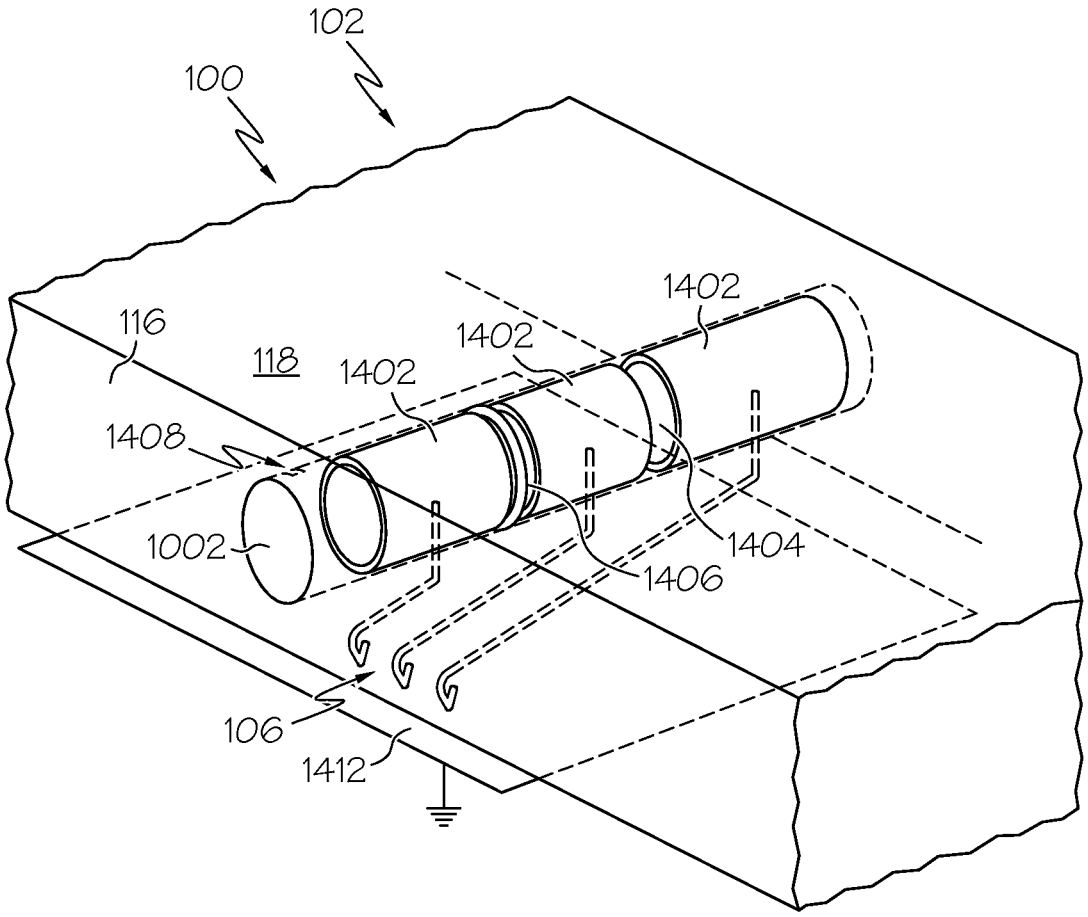
FIG. 14 is a top front perspective view of another example of a connector assembly with a multipart sleeve disposed within the opening formed in the housing.

FIG. 14 is a top front perspective view of another example of a connector assembly with a multipart sleeve 1402 disposed within the aperture 152 in case 118. Separate multipart sections 1402 may be insulated from each other in accordance with the requirements of the application of connector 100. Insulation may be accomplished, for example, by spacing 1404 between sections 1402, by providing one or more insulating rings 1406, by insulating protrusions, projections 1408 in case material 116 or a combination thereof. The one or more sections 1402 may be assembled within case material 116 during manufacturing of case 118, for example by insert injection molding, by being press-fit, adhered within a bore or connection aperture 152 in case material 116, or a combination thereof. Conductors 106 may be formed in case material 116 by insert injection molding, may be molded within material 116, or incorporated by any of the manufacturing methods described herein.

One or more electrostatic discharge (ESD) shields 1412 may be positioned relative to any of the examples of connector 100, to reduce a potential for interference from, or to, a signal passing through connector 100.

Figure 15:
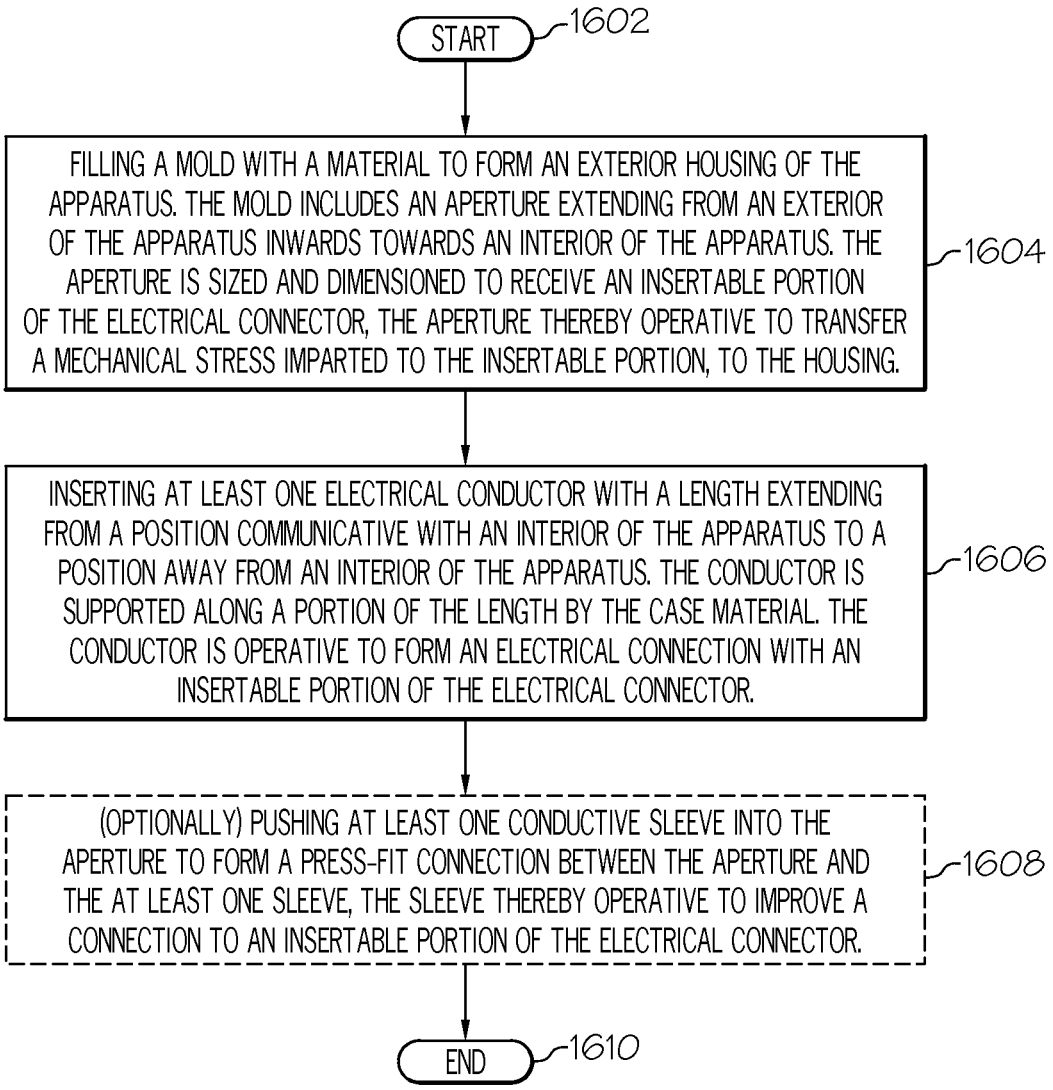
FIG. 15 is an example flow diagram of fabrication steps for the connector assembly.

Turning now to FIG. 15, shown is a flow diagram of example for fabricating the connector assembly. The process begins in step 1602 and immediately proceeds to step 1604, in which a mold is filled with a material to form an exterior housing of an apparatus. The mold includes an aperture extending from the interior of the apparatus to the exterior of the apparatus. The aperture is dimensioned to receive an insertable portion of the electrical connector. The house is designed to withstand mechanical stress imparted to the insertable portion of the housing. Next, in step 1606, an electrical conductor is inserted into the aperture. In one example, the electrical conductor has a length extending from a position communicating with the interior of the apparatus to a position away from the interior of the apparatus. The electrical conductor is supported along at least a portion of its length by the aperture in the material. The conductor forms an electrical connection with an insertable portion of the electrical connector. In an optional step, 1608, at least one conductive sleeve is pushed into the aperture to form a press-fit connection between the aperture and the sleeve. The fabrication process ends in step 1610.

Figure 16:
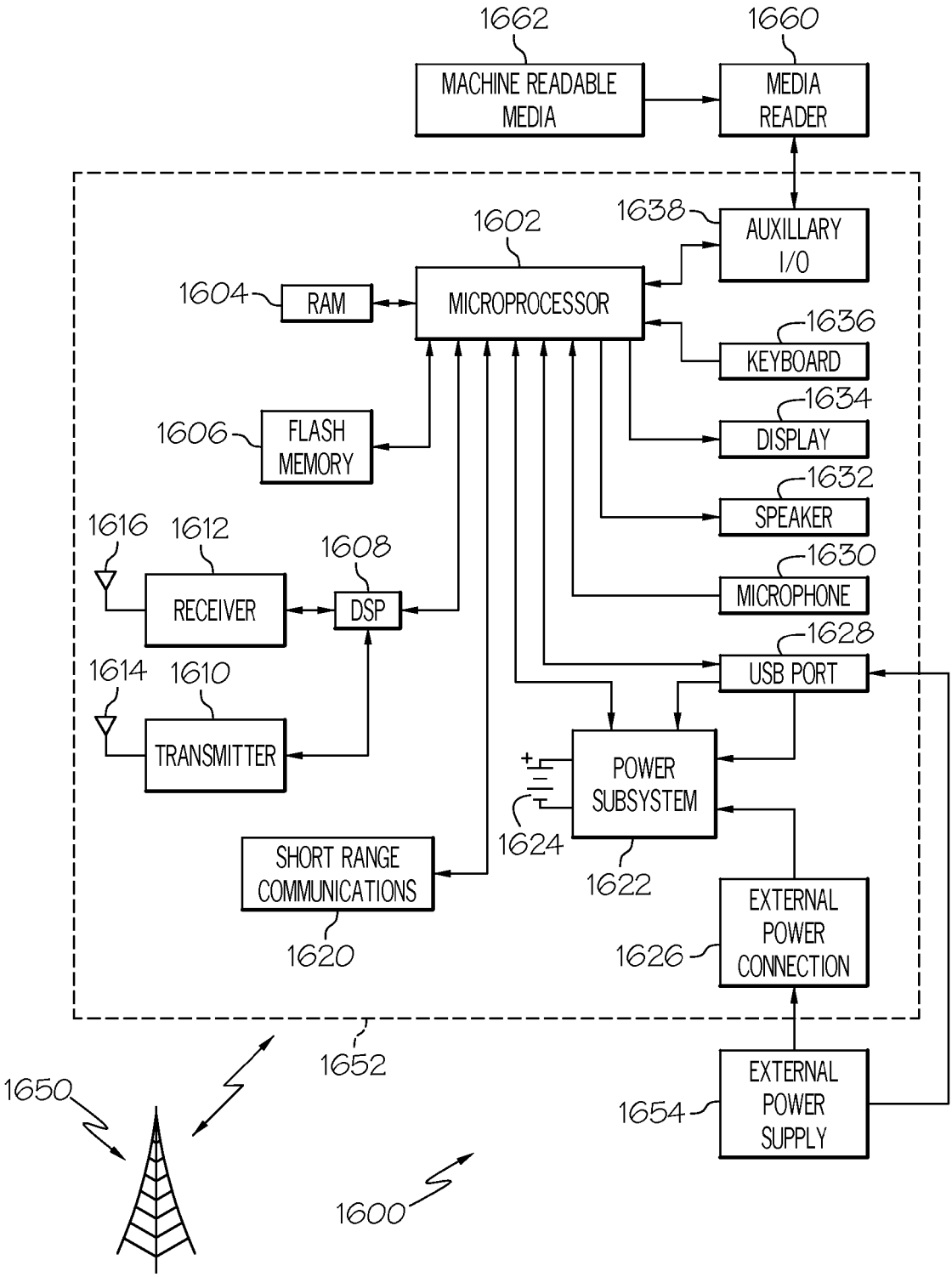
FIG. 16 is a block diagram illustrating a detailed view of a handheld electronic device with a connector.

Turning now to FIG. 16, shown is a block diagram of a handheld electronic device and associated components 1600 that may house connector 100. In this example, a handheld electronic device 1652 is a wireless two-way communication device with voice and data communication capabilities. Such electronic devices communicate with a wireless voice or data network 1650 using a suitable wireless communications protocol. Wireless voice communications are performed using either an analog or digital wireless communication channel. Data communications allow the electronic device 1652 to communicate with other computer systems via the Internet. Examples of electronic devices that are able to incorporate the above described systems and methods include, for example, a data messaging device, a two-way pager, a cellular telephone with data messaging capabilities, a wireless Internet appliance or a data communication device that may or may not include telephony capabilities.

The illustrated electronic device 1652 is an example electronic device that includes two-way wireless communications functions. Such electronic devices incorporate communication subsystem elements such as a wireless transmitter 1610, a wireless receiver 1612, and associated components such as one or more antenna elements 1614 and 1616. A digital signal processor (DSP) 1608 performs processing to extract data from received wireless signals and to generate signals to be transmitted. The particular design of the communication subsystem is dependent upon the communication network and associated wireless communications protocols with which the device is intended to operate.

The electronic device 1652 includes a microprocessor 1602 that controls the overall operation of the electronic device 1652. The microprocessor 1602 interacts with the above described communications subsystem elements and also interacts with other device subsystems such as flash memory 1606, random access memory (RAM) 1604, auxiliary input/output (I/O) device 1638, data port 1628, display 1634, keyboard 1636, speaker 1632, microphone 1630, a short-range communications subsystem 1620, a power subsystem 1622, and any other device subsystems.

A battery 1624 is connected to a power subsystem 1622 to provide power to the circuits of the electronic device 1652. The power subsystem 1622 includes power distribution circuitry for providing power to the electronic device 1652 and also contains battery charging circuitry to manage recharging the battery 1624. The power subsystem 1622 includes a battery monitoring circuit that is operable to provide a status of one or more battery status indicators, such as remaining capacity, temperature, voltage, electrical current consumption, and the like, to various components of the electronic device 1652.

The data port 1628 of one example is a receptacle connector 104 or a connector to which an electrical and optical data communications circuit connector 1600 engages and mates, as described above. The data port 1628 is able to support data communications between the electronic device 1652 and other devices through various modes of data communications, such as high speed data transfers over an optical communications circuits or over electrical data communications circuits such as a USB connection incorporated into the data port 1628 of some examples. Data port 1628 is able to support communications with, for example, an external computer or other device.

Data communication through data port 1628 enables a user to set preferences through the external device or through a software application and extends the capabilities of the device by enabling information or software exchange through direct connections between the electronic device 1652 and external data sources rather then via a wireless data communication network. In addition to data communication, the data port 1628 provides power to the power subsystem 1622 to charge the battery 1624 or to supply power to the electronic circuits, such as microprocessor 1602, of the electronic device 1652.

Operating system software used by the microprocessor 1602 is stored in flash memory 1606. Further examples are able to use a battery backed-up RAM or other non-volatile storage data elements to store operating systems, other executable programs, or both. The operating system software, device application software, or parts thereof, are able to be temporarily loaded into volatile data storage such as RAM 1604. Data received via wireless communication signals or through wired communications are also able to be stored to RAM 1604.

The microprocessor 1602, in addition to its operating system functions, is able to execute software applications on the electronic device 1652. A specified set of applications that control basic device operations, including at least data and voice communication applications, is able to be installed on the electronic device 1652 during manufacture. Examples of applications that are able to be loaded onto the device may be a personal information manager (PIM) application having the ability to organize and manage data items relating to the device user, such as, but not limited to, e-mail, calendar events, voice mails, appointments, and task items.

Further applications may also be loaded onto the electronic device 1652 through, for example, the wireless network 1650, an auxiliary I/O device 1638, data port 1628, short-range communications subsystem 1620, or any combination of these interfaces. Such applications are then able to be installed by a user in the RAM 1604 or a non-volatile store for execution by the microprocessor 1602.

In a data communication mode, a received signal such as a text message or web page download is processed by the communication subsystem, including wireless receiver 1612 and wireless transmitter 1610, and communicated data is provided the microprocessor 1602, which is able to further process the received data for output to the display 1634, or alternatively, to an auxiliary I/O device 1638 or the data port 1628. A user of the electronic device 1652 may also compose data items, such as e-mail messages, using the keyboard 1636, which is able to include a complete alphanumeric keyboard or a telephone-type keypad, in conjunction with the display 1634 and possibly an auxiliary I/O device 1638. Such composed items are then able to be transmitted over a communication network through the communication subsystem.

For voice communications, overall operation of the electronic device 1652 is substantially similar, except that received signals are generally provided to a speaker 1632 and signals for transmission are generally produced by a microphone 1630. Alternative voice or audio I/O subsystems, such as a voice message recording subsystem, may also be implemented on the electronic device 1652. Although voice or audio signal output is generally accomplished primarily through the speaker 1632, the display 1634 may also be used to provide an indication of the identity of a calling party, the duration of a voice call, or other voice call related information, for example.

Depending on conditions or statuses of the electronic device 1652, one or more particular functions associated with a subsystem circuit may be disabled, or an entire subsystem circuit may be disabled. For example, if the battery temperature is low, then voice functions may be disabled, but data communications, such as e-mail, may still be enabled over the communication subsystem.

A short-range communications subsystem 1620 provides for data communication between the electronic device 1652 and different systems or devices, which need not necessarily be similar devices. For example, the short-range communications subsystem 1620 includes an infrared device and associated circuits and components or a Radio Frequency based communication module such as one supporting Bluetooth® communications, to provide for communication with similarly-enabled systems and devices, including the data file transfer communications described above.

A media reader 1660 is able to be connected to an auxiliary I/O device 1638 to allow, for example, loading computer readable program code of a computer program product into the electronic device 1652 for storage into flash memory 1606. One example of a media reader 1660 is an optical drive such as a CD/DVD drive, which may be used to store data to and read data from a computer readable medium or storage product such as computer readable storage media 1662. Examples of suitable computer readable storage media include optical storage media such as a CD or DVD, magnetic media, or any other suitable data storage device. Media reader 1660 is alternatively able to be connected to the electronic device through the data port 1628 or computer readable program code is alternatively able to be provided to the electronic device 1652 through the wireless network 1650. The auxiliary I/O device 1638 in one example includes connector 100.

NON-LIMITING EXAMPLES

Although specific examples of the subject matter have been disclosed, those having ordinary skill in the art will understand that changes can be made to the specific examples without departing from the spirit and scope of the disclosed subject matter. The scope of the disclosure is not to be restricted, therefore, to the specific examples, and it is intended that the appended claims cover any and all such applications, modifications, and examples within the scope of the present disclosure.

The invention claimed is:

1. An apparatus comprising:

an outer case housing forming a portion of an exterior surface of an apparatus, the outer case housing including an aperture extending from an exterior of the apparatus, inwards towards an interior of the apparatus, the aperture sized and dimensioned as an opening of a receptacle to receive an insertable plug portion of an electrical connector, the outer case housing thereby operative to provide mechanical support for the insertable plug portion when the insertable plug portion is inserted into the aperture during contact with the receptacle; and at least one electrical conductor with a length extending from a position communicative with the interior of the apparatus to the exterior of the apparatus, the electrical conductor supported along the length by the outer case housing thereby forming the receptacle-using the outer case and the electrical conductor, and without using a separate receptacle housing.

2. The apparatus of claim 1, wherein the at least one electrical conductor is a multipart sectional connector with each section insulated from an adjacent section.

3. The apparatus of claim 1, wherein the at least one electrical conductor is press-fit into the aperture.

4. The apparatus of claim 1, wherein the at least one electrical conductor is injection molded into the aperture.

5. The apparatus of claim 1, wherein the housing is formed using insert injection molding.

6. The apparatus of claim 1, wherein a substantial portion of an exterior surface and the aperture are formed as a continuous single piece of a material of the housing.

7. The apparatus of claim 1, wherein the housing is formed with at least two portions, each of the at least two portions forming a substantial portion of an exterior surface of the apparatus, at least two of the at least two portions mateable to form the aperture.

8. The apparatus of claim 1, wherein the aperture is sized and dimensioned to support the electrical connector comprising at least one of an audio connector, a power connector, a network connector, and an antenna connector.

9. The apparatus of claim 1, wherein the length of the at least one electrical conductor extending away from an interior of the aperture extends in a direction of a mounting location of an electrical circuit board within the housing when the housing is assembled.

10. The apparatus of claim 9, wherein the length of the at least one electrical conductor extending away from an interior of the aperture includes a portion operative to form a resilient connection with the electric circuit board.

11. An apparatus connectable to an electrical connector, comprising:

a housing including an outer case continuously forming, as a unitary piece, a portion of an exterior surface of the apparatus and an aperture communicating from an exterior of the apparatus, inwards towards an interior of the apparatus, the aperture sized and dimensioned as an opening of a receptacle to receive an insertable plug portion of the connectable electrical connector, the aperture thereby operative to transfer mechanical stress imparted to an insertable plug portion of the connectable electrical connector to the outer case; and at least one electrical conductor with a length extending from a position communicative the interior of the apparatus to a position away from an interior of the aperture, the conductor supported along at least a portion of the length by the outer case thereby the receptacle-using the outer case and the electrical conductor, and without using a separate receptacle housing.

12. The apparatus of claim 11, wherein the at least one electrical conductor is a multipart sectional connector with each section insulated from an adjacent section.

13. The apparatus of claim 11, wherein the at least one electrical conductor is press-fit into the aperture.

14. A method of fabricating an apparatus connectable to an electrical connector having an insertable plug portion, the method comprising:

fabricating a housing including an outer case from a material that continuously forms, as a unitary piece, a portion of an exterior surface of the apparatus and an aperture extending from an exterior of the apparatus, inwards towards an interior of the apparatus, the aperture sized and dimensioned as an opening of a receptacle to receive the insertable plug portion of the electrical connector, the aperture thereby operative to transfer a mechanical stress imparted to the insertable plug portion, to the outer case; and positioning within the housing at least one electrical conductor with a length extending from a position communicative with the interior of the apparatus to a position away from an interior of the aperture, the conductor supported along at least a portion of the length by the outer case thereby the receptacle-using the outer case and the electrical conductor, and without using a separate receptacle housing.

15. The method of claim 14, further including pushing into the aperture, the at least one electrical conductor, to thereby form a press-fit connection between the aperture and the at least one electrical conductor.

16. The method of claim 15, further including injection molding into the aperture, the at least one electrical conductor.

17. The method of claim 15, wherein the at least one electrical conductor is a multipart sectional connector with each section insulated from an adjacent section.

* * * * *